US012799675B2

(12) United States Patent
Chen et al.

(10) Patent No.: US 12,799,675 B2
(45) Date of Patent: Nov. 17, 2026

(54) METHOD FOR IMPROVING SURFACE STRUCTURE OF REGENERATED CELLULOSE FIBER

(71) Applicant: QILU UNIVERSITY OF TECHNOLOGY (SDAS), Jinan (CN)

(72) Inventors: Jiachuan Chen, Jinan (CN); Guihua Yang, Jinan (CN); Yu Xue, Jinan (CN); Letian Qi, Jinan (CN); Zhaoyun Lin, Jinan (CN)

(73) Assignee: QILU UNIVERSITY OF TECHNOLOGY (SDAS), Jinan (CN)

( * ) Notice: Subject to any disclaimer, the term of this patent is extended or adjusted under 35 U.S.C. 154(b) by 93 days.

(21) Appl. No.: 18/706,955

(22) PCT Filed: Jun. 21, 2023

(86) PCT No.: PCT/CN2023/101549
§ 371 (c)(1),
(2) Date: May 2, 2024

(87) PCT Pub. No.: WO2023/208257
PCT Pub. Date: Nov. 2, 2023

(65) Prior Publication Data

US 2026/0160022 A1 Jun. 11, 2026

(30) Foreign Application Priority Data

Apr. 29, 2022 (CN) ..... 202210466239.2

(51) Int. Cl.
*D21H 13/08* (2006.01)
*D01D 1/02* (2006.01)
(Continued)

(52) U.S. Cl.
CPC ..... *D21H 13/08* (2013.01); *D01D 1/02* (2013.01); *D01D 5/06* (2013.01); *D01F 2/08* (2013.01)

(58) Field of Classification Search
CPC ..... D21H 13/08
(Continued)

(56) References Cited

U.S. PATENT DOCUMENTS 10,323,354 B2 * 6/2019 Kawahara ..... D21H 17/46

FOREIGN PATENT DOCUMENTS

CN 105113034 A 12/2015
CN 110003500 A 7/2019
(Continued)

OTHER PUBLICATIONS

1st Chinese Office Action, English Translation.
(Continued)

*Primary Examiner* — Jacob T Minskey
(74) *Attorney, Agent, or Firm* — BROOKS KUSHMAN P.C.

(57) ABSTRACT

A method for improving a surface structure of a regenerated cellulose fiber, including: subjecting a mixture of 3-halopropene and an imidazole-type reagent to substitution reaction to obtain an imidazole-type hydrogen bond acceptor; mixing a hydrogen bond donor, a hydrogen bond acceptor enhancer and the imidazole-type hydrogen bond acceptor to obtain a dissolving system; mixing a wood pulp and the dissolving system, and dissolving cellulose of the wood pulp to obtain a cellulose solution; and subjecting the cellulose solution to spinning with dry-jet wet spinning process to obtain a regenerated product, and drying the regenerated product to obtain the regenerated cellulose fiber; where the imidazole-type reagent has a structural formula of
(Continued)

R being selected from the group consisting of H, alkyl, and alkenyl.

8 Claims, 2 Drawing Sheets

(51) Int. Cl.
*D01D 5/06* (2006.01)
*D01F 2/08* (2006.01)

(58) Field of Classification Search
USPC ..... 162/157.6
See application file for complete search history.

(56) References Cited

FOREIGN PATENT DOCUMENTS

| | | | |
|---|---|---|---|
| CN | 113481619 | A | 10/2021 |
| CN | 114105995 | A | 3/2022 |
| CN | 114775087 | A | 7/2022 |
| KR | 20220013262 | A | 2/2022 |
| WO | 2019077208 | A1 | 4/2019 |

OTHER PUBLICATIONS

International Search Report, English Translation.
Nonpatent literature reference entitled, "Introduction to Green Chemistry: Second Edition" by Jinjun Li et al., English Title Page and Machine Translation of relevant passage.
First Office Action for Chinese Application No. 202210466239.2, dated Mar. 10, 2023, 4 Pages.
International Search Report for Application No. PCT/CN2023/101549, dated Sep. 15, 2023, 5 Pages.
Li et al., "Overview of Deep Eutectic Solvents," Introduction to Green Chemistry, Second Edition, Aug. 31, 2015, p. 81, ISBN 978-7-30-16389-8, Wuhan University Press, Luojiashan, Wuchang, China, 3 pages.

* cited by examiner

METHOD FOR IMPROVING SURFACE STRUCTURE OF REGENERATED CELLULOSE FIBER

CROSS-REFERENCE TO RELATED APPLICATIONS

This application is the U.S. national phase of PCT Application No. PCT/CN2023/101549 filed on Jun. 21, 2023, which claims priority to Chinese Patent Application No. 202210466239.2 filed on Apr. 29, 2022, which are incorporated herein by reference in their entireties.

TECHNICAL FIELD

The present disclosure belongs to the technical field of bio-based materials preparation, and specifically relates to a method for improving a surface structure of a regenerated cellulose fiber.

BACKGROUND

Information disclosed in the background is merely intended to facilitate the understanding of the general background of the present disclosure, and is not necessarily regarded as an acknowledgment or any form of implication that the information constitutes the prior art already known to those of ordinary skill in the art.

Cellulose, as a natural polymer that exists in abundance in nature, is naturally degradable and sustainable. Cellulose-based materials have many advantages such as light weight, desirable air permeability, environmental friendliness, and wide range of sources. The basic structure of cellulose is a polymer composed of β-D-glucopyranosyl groups linked by 1,4-β-glycoside bonds, and there are many hydrogen bonds between the molecules. Due to a complex structure as well as difficulty in dissolving in water and common organic solvents, cellulose is also prone to certain restrictions in use and development.

Hydrogen bond acceptors and hydrogen bond donors serve as desirable solvents to change a hydrogen bond structure and can destroy the hydrogen bonds inside and between cellulose macromolecules, resulting in dissociation of the aggregated state of cellulose molecules and thereby dispersing and dissolving in solvents, and cellulose fibers are obtained through subsequent regeneration. Performances of cellulose fibers depend on different dissolution and regeneration processes. Fibers with different performances could be used in various fields such as textiles, medicine, materials, and energy, showing broad application prospects. Moreover, the surface structure of regenerated cellulose fibers has a great influence on their strength and other performances, and determines the field of their subsequent application. In view of this, it is of great significance to improve and enhance the surface structure of regenerated cellulose fibers.

SUMMARY

The present disclosure aims to provide a method for improving a surface structure of a regenerated cellulose fiber. Wood pulp is used as a raw material and dissolved in an imidazole-type hydrogen bond acceptor; a hydrogen bond donor, a hydrogen bond acceptor enhancer, and nanocellulose are added into a resulting dissolving system to enhance performances of regenerated cellulose fibers. During dissolution and regeneration of cellulose, the density and smoothness of the surface of regenerated cellulose fibers are improved by regulating the distribution of hydrogen bonds, and the strength and thermal stability of regenerated cellulose fibers are further improved. The method according to the present disclosure is simple and efficient, with low addition amounts and significant effects.

To achieve the above object, the present disclosure provides the following technical solutions.

In the first aspect, the present disclosure provides a method for improving a surface structure of a regenerated cellulose fiber, including the following steps:

- subjecting a mixture of 3-halopropene and an imidazole reagent to substitution reaction to obtain an imidazole-type hydrogen bond acceptor;
- mixing a hydrogen bond donor, a hydrogen bond acceptor enhancer and the imidazole-type hydrogen bond acceptor to obtain a dissolving system;
- mixing a wood pulp and the dissolving system, and dissolving cellulose of the wood pulp to obtain a cellulose solution; and
- subjecting the cellulose solution to spinning with dry-jet wet spinning process to obtain a regenerated product, and drying the regenerated product to obtain the regenerated cellulose fiber;
- where the imidazole-type reagent has a structural formula of

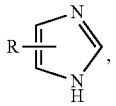

R being selected from the group consisting of H, alkyl, and alkenyl.

In the present disclosure, it has been found that performance of the regenerated cellulose fiber could be improved by regulating distribution and ratio of the hydrogen bond donor and the hydrogen bond acceptor in the dissolving system composed of the hydrogen bond donor, the hydrogen bond acceptor enhancer, and the imidazole-type hydrogen bond acceptor; the amount of the hydrogen bond donor and the hydrogen bond acceptor in the dissolving system is in a small amount, and desirable effect however could be achieved. Furthermore, the elastic modulus and viscous modulus of cellulose viscose could be increased, which is beneficial to the preparation and production of regenerated cellulose fibers. In particular, nanocellulose is additionally added into the dissolving system, resulting in further significant enhancement and improvement of the performances of regenerated cellulose fibers.

In the second aspect, the present disclosure further provides a regenerated cellulose fiber prepared by the method as described in the above solutions.

The regenerated cellulose fiber according to the present disclosure has a relatively high surface smoothness.

In the third aspect, the present disclosure also provides use of the regenerated cellulose fiber as described in the above solutions in the field of textiles or functional materials.

In the fourth aspect, the present disclosure further provides use of the method as described in the above solutions in preparation of a regenerated cellulose fiber by treating a cotton pulp, a bamboo pulp, a wheat straw pulp, or a dissolving pulp.

The present disclosure has the following beneficial effects.

(1) In the present disclosure, the wood pulp is dissolved in the dissolving system formed by mixing the hydrogen bond donor, the hydrogen bond acceptor enhancer, and the imidazole-type hydrogen bond acceptor. During the dissolution and regeneration of cellulose, the surface structure and fiber strength of the regenerated cellulose fiber are improved by adjusting the distribution of hydrogen bonds. Especially, nanocellulose is additionally added to the dissolving system, resulting in further significant enhancement and improvement of the performances of the regenerated cellulose fiber.

(2) The regenerated cellulose fiber according to the present disclosure has a compact and smooth surface structure, and exhibits advantages such as relatively high physical strength, more desirable softness and thermal stability. The method according to the present disclosure is also suitable for various raw materials, such as cotton pulp, bamboo pulp, wheat straw pulp, and dissolving pulp.

(3) In the present disclosure, the hydrogen bond donor, hydrogen bond acceptor enhancer, and nanocellulose have a small amount and a relatively low cost, thereby reducing the production cost of the regenerated cellulose fiber.

(4) The method according to the present disclosure is simple, highly practical, and easy to be popularized.

BRIEF DESCRIPTION OF THE DRAWINGS

To describe the technical solutions in embodiments of the present disclosure or in the prior art more clearly, the accompanying drawings required for the examples are briefly described below. Apparently, the accompanying drawings in the following description show merely some examples of the present disclosure, and those of ordinary skill in the art may still derive other accompanying drawings from these accompanying drawings without creative efforts.

DETAILED DESCRIPTION OF THE EMBODIMENTS

Figure 1:
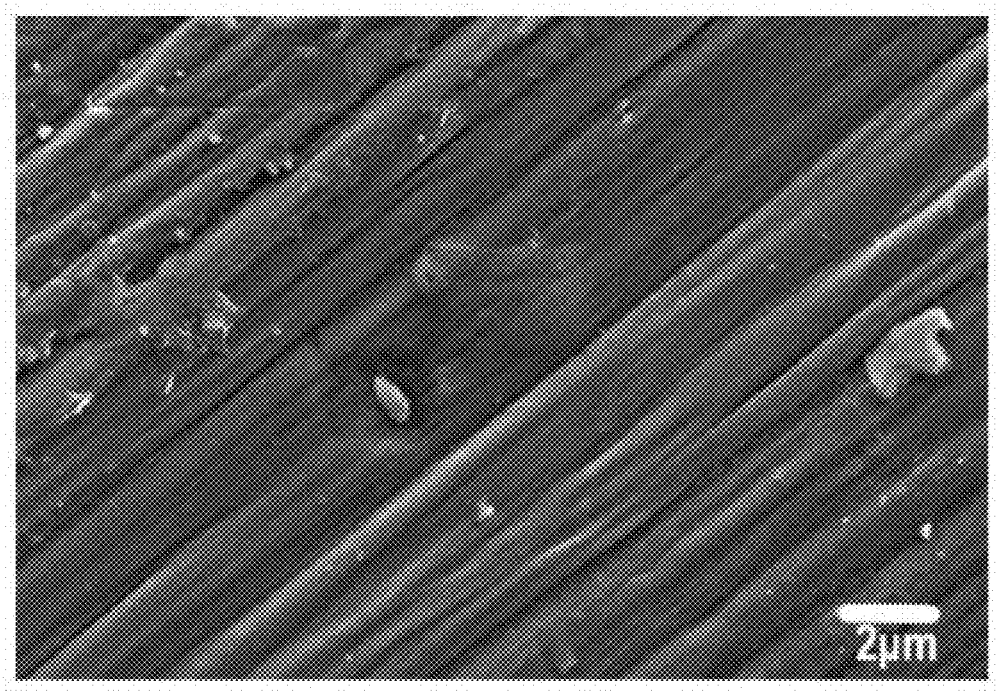
FIG. 1 shows a scanning electron microscopy (SEM) image of the surface of the regenerated cellulose fiber prepared in the Comparative Example according to the present disclosure.

It should be pointed out that the following detailed descriptions are all exemplary and are intended to provide further depiction of the present disclosure. All technical and scientific terms used herein have the same meaning as commonly understood by those of ordinary skill in the art to which the present disclosure belongs unless otherwise defined.

It should be noted that terms used herein are merely for describing specific embodiments and are not intended to limit exemplary embodiments according to the present disclosure. As used herein, unless otherwise specified herein, a singular form is also intended to include plural forms. In addition, it should also be understood that when the terms "comprise/comprising" and/or "include/including" are used in this specification, they indicate the presence of features, steps, operations, devices, components, and/or combinations thereof.

As introduced in the background, the surface structure of regenerated cellulose fibers has a great influence on the performance of fibers per se, such as strength, initial modulus, and elongation. Moreover, the surface structure is also an important factor in determining subsequent functionalization processes such as surface coating and surface modification. Accordingly, the present disclosure provides a method for improving a surface structure of a regenerated cellulose fiber.

The present disclosure provides a method for improving a surface structure of a regenerated cellulose fiber, including the following steps:

subjecting a mixture of 3-halopropene and an imidazole reagent to substitution reaction to obtain an imidazole-type hydrogen bond acceptor;

mixing a hydrogen bond donor, a hydrogen bond acceptor enhancer and the imidazole-type hydrogen bond acceptor to obtain a dissolving system;

mixing a wood pulp and the dissolving system, and dissolving cellulose of the wood pulp to obtain a cellulose solution; and subjecting the cellulose solution to spinning with dry-jet wet spinning process to obtain a regenerated product, and drying the regenerated product to obtain the regenerated cellulose fiber;

where the imidazole-type reagent has a structural formula of

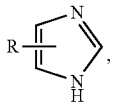

R being selected from the group consisting of H, alkyl, and alkenyl.

In the present disclosure, performances of the regenerated cellulose fiber could be improved by regulating distribution of the hydrogen bond donor and the hydrogen bond acceptor in the dissolving system formed by mixing the hydrogen bond donor, the hydrogen bond acceptor enhancer, and the imidazole-type hydrogen bond acceptor.

In some embodiments, 3-halopropene is selected from the group consisting of 3-chloropropene, 3-bromopropene, and 3-iodopropene.

In some embodiments, the

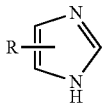

is selected from the group consisting of

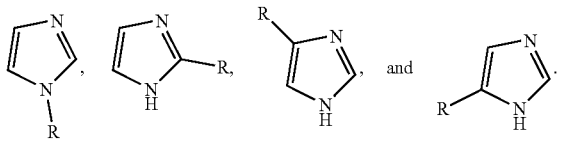

In some embodiments, R is $C_1$ to $C_5$ alkyl; and the imidazole-type reagent is selected from the group consisting of 1-methylimidazole, 2-methylimidazole, 4-methylimidazole, 1-ethylimidazole, 1-propylimidazole, and imidazole.

In some embodiments, the substitution reaction is conducted under an inert atmosphere at a temperature of 60° C. to 80° C. for 8 h to 24 h.

In some embodiments, the method as described in the above solutions further includes adding nanocellulose into the dissolving system. Studies have shown that adding the nanocellulose into the dissolving system could further regulate the distribution of the hydrogen bond donor and the hydrogen bond acceptor in the dissolving system, thereby significantly improving the performances of the regenerated cellulose fiber. The nanocellulose includes, but is not limited to, one or more of nanocellulose fibril, nanocellulose fiber, and nanocellulose crystallite.

In some embodiments, the hydrogen bond donor includes, but is not limited to, one or more selected from the group consisting of urea, formic acid, ethylene glycol, oxalic acid, glycerol, acetamide, malonic acid, and lactic acid.

In some embodiments, the hydrogen bond acceptor enhancer includes, but is not limited to, one or more selected from the group consisting of choline chloride, tetrabutylammonium bromide, tetrabutylphosphonium bromide, and betaine.

In some embodiments, an amount of the imidazole-type hydrogen bond acceptor accounts for 90.0% to 98.0% of a total molar weight of the dissolving system. Specifically, alternatively, a total of 0.2 mol to 1.0 mol of the hydrogen bond donor and the hydrogen bond acceptor enhancer are added into 10 mol of the imidazole-type hydrogen bond acceptor; a total of 0.2 mol to 1.0 mol of the hydrogen bond donor, the hydrogen bond acceptor enhancer, and the nanocellulose are added to 10 mol of the imidazole-type hydrogen bond acceptor.

In some embodiments, the wood pulp is a chemical pulp; and the chemical pulp has a moisture content of 8% to 12% (by mass percentage). The chemical pulp could reduce a dissolution time of cellulose in the dissolving system.

In some embodiments, the wood pulp is in an amount of 5 wt % to 15 wt % (by mass percentage) of a total amount of the dissolving system, and mixing the wood pulp and the dissolving system is conducted at a temperature of 80° C. to 100° C., and the dissolving is conducted for 5 min to 15 min.

In some embodiments, the spinning with dry-jet wet spinning process is conducted by: pouring the cellulose solution into a single-screw extruder, and conducting a dry-jet wet spinning at a screw length-to-diameter ratio of 20:1 to 30:1 and a screw speed of preferably 50 rpm to 60 rpm. There is no special limitation on a rotational speed of the extruder and a pore size of a spinning nozzle.

In some embodiments, during the dry-jet wet spinning, a resulting cellulose solution extruded from a spinning nozzle falls vertically into a coagulation liquid at an air gap of 10 mm to 30 mm; and the coagulation liquid has a concentration of an another imidazole-type hydrogen bond acceptor of 0% to 30%; and the coagulation liquid is at a temperature of 10° C. to 60° C.

In some embodiments, the coagulation liquid has a concentration of 0% to 30% and a temperature of 10° C. to 60° C.

In some embodiments, drying the regenerated product is conducted by: washing the regenerated product until a content of the imidazole-type hydrogen bond acceptor inside the regenerated product is not more than 2%, and then drying a resulting washed product by using hot air at a temperature of 105° C. to 120° C. in a draw ratio of 1:(0.9-1.1).

The present disclosure further provides a regenerated cellulose fiber prepared by the method as described in the above solutions.

The regenerated cellulose fiber according to the present disclosure has a relatively high surface smoothness.

The present disclosure further provides use of the regenerated cellulose fiber as described in the above solutions in the field of textiles or functional materials.

The present disclosure further provides use of the method in preparation of the regenerated cellulose fiber by treating a cotton pulp, a bamboo pulp, a wheat straw pulp, or a dissolving pulp.

In order to enable those skilled in the art to understand the technical solutions of the present disclosure more clearly, the technical solutions of the present disclosure will be described in detail below with reference to specific examples and comparative examples. However, these examples and comparative examples cannot be understood as limiting the scope of the present disclosure.

COMPARATIVE EXAMPLE (1) 5 mol of 3-chloropropene was slowly added dropwise into 5 mol of 1-methylimidazole, and a resulting mixture was then subjected to a reaction at 70° C. for not less than 8 h under nitrogen protection to obtain an imidazole-type hydrogen bond acceptor.

(2) 15.9 g of a softwood dissolving pulp (with a moisture content of 9.2%) was dispersed, and then mixed with 160 g of the imidazole-type hydrogen bond acceptor synthesized in step (1), and stirred mechanically at 80° C. for 10 min.

(3) A resulting uniformly-mixed cellulose viscose (i.e., a cellulose solution) was fed into a single-screw extruder with a screw length-to-diameter ratio of 25:1 and a screw speed of 60 rpm. From a feeding port to an extrusion outlet, four stages of temperature zones were configured, the temperature of which were 80° C., 165° C., 160° C. and 120° C., respectively. An extrusion head was a vertical single-hole spinning nozzle made of brass and with a diameter of 0.8 mm, and the extrusion mode was dry-jet wet spinning. A resulting cellulose solution extruded from the spinning nozzle fell vertically into a coagulation liquid at an air gap of 20 mm, where a coagulation bath was distilled water at 25° C.

Example 1

A method for improving a surface structure of a regenerated cellulose fiber was performed as follows:

(1) 10 mol of 3-chloropropene was slowly added dropwise into 10 mol of 1-ethylimidazole, and a resulting mixture was then subjected to a reaction at 100° C. for not less than 24 h under nitrogen protection to obtain a hydrogen bond acceptor.

(2) 4.4 g of choline chloride (as a hydrogen bond acceptor enhancer) was added into 100 g of the hydrogen bond acceptor (with a moisture content of 0.96%) synthesized in step (1) by slowly stirring, and then stirred mechanically at 120° C. for 30 min until mixed evenly to obtain a dissolving system.

(3) 10.4 g of a softwood kraft pulp (with a moisture content of 8.6%) was dispersed, and then mixed with the dissolving system, and stirred mechanically at 80° C. for 10 min.

(4) A resulting uniformly-mixed cellulose viscose (i.e., a cellulose solution) was fed into a single-screw extruder with a screw length-to-diameter ratio of 25:1 and a screw speed of 50 rpm. From a feeding port to an extrusion outlet, four stages of temperature zones were configured, the temperature of which each were 80° C., 165° C., 150° C., and 120° C., respectively. An extrusion head was a vertical single-hole spinning nozzle made of brass and with a diameter of 0.8 mm, and the extrusion mode was dry-jet wet spinning. A resulting cellulose solution extruded from the spinning nozzle fell vertically into a coagulation liquid at an air gap of 20 mm, where a coagulation bath was distilled water at 25° C.

(5) A resulting coagulated fiber was washed three times with distilled water at 25° C. and then three times with distilled water at 60° C., and a resulting washed fiber was dried with hot air (at 105° C. for 15 min) in a draw ratio of 1:1.

Example 2

A method for improving a surface structure of a regenerated cellulose fiber was performed as follows:

(1) 10 mol of 3-chloropropene was slowly added dropwise into 10 mol of 1-methylimidazole, and a resulting mixture was then subjected to a reaction at 100° C. for not less than 24 h under nitrogen protection to obtain a hydrogen bond acceptor.

(2) 1.76 g of urea (as a hydrogen bond acceptor enhancer) and 2.74 g of choline chloride (as a hydrogen bond donor) were added into 155.68 g of the hydrogen bond acceptor (with a moisture content of 0.31%) synthesized in step (1) by slowly stirring, and then stirred mechanically at 120° C. for 30 min until mixed evenly to obtain a dissolving system.

(3) 15.9 g of a softwood dissolving pulp (with a moisture content of 9.2%) was dispersed, and then mixed with the dissolving system, and stirred mechanically at 80° C. for 10 min.

(4) A resulting uniformly-mixed cellulose viscose (i.e., a cellulose solution) was fed into a single-screw extruder with a screw length-to-diameter ratio of 27:1 and a screw speed of 55 rpm. From a feeding port to an extrusion outlet, four stages of temperature zones were configured, the temperature of which each were 80° C., 165° C., 160° C., and 120° C., respectively. An extrusion head was a vertical single-hole spinning nozzle made of brass and with a diameter of 0.8 mm, and the extrusion mode was dry-jet wet spinning. A resulting cellulose solution extruded from the spinning nozzle and fell vertically into a coagulation liquid at an air gap of 20 mm, where a coagulation bath was a 10% hydrogen bond acceptor aqueous solution at 25° C.

(5) A resulting coagulated fiber was washed three times with distilled water at 25° C. and then three times with distilled water at 60° C., and a resulting washed fiber was dried with hot air (at 105° C. for 15 min) in a draw ratio of 1:1.

Example 3

A method for improving a surface structure of a regenerated cellulose fiber was performed as follows:

(1) 10 mol of 3-chloropropene was slowly added dropwise into 10 mol of 1-ethylimidazole, and a resulting mixture was then subjected to a reaction at 100° C. for not less than 24 h under nitrogen protection to obtain a hydrogen bond acceptor.

(2) 2.06 g of glycerol (as a hydrogen bond acceptor enhancer) and 2.34 g of choline chloride (as a hydrogen bond donor) were added into 154.22 g of the hydrogen bond acceptor (with a moisture content of 0.38%) synthesized in step (1) by slowly stirring, and then stirred mechanically at 120° C. for 30 min until mixed evenly to obtain a dissolving system.

(3) 16.01 g of a softwood kraft pulp (with a moisture content of 8.6%) was dispersed, and then mixed with the dissolving system, and stirred mechanically at 80° C. for 10 min.

(4) A resulting uniformly-mixed cellulose viscose (i.e., a cellulose solution) was fed into a single-screw extruder with a screw length-to-diameter ratio of 25:1 and a screw speed of 50 rpm. From a feeding port to an extrusion outlet, four stages of temperature zones were configured, the temperature of which each were 80° C., 165° C., 150° C., and 120° C., respectively. An extrusion head was a vertical single-hole spinning nozzle made of brass and with a diameter of 0.8 mm, and the extrusion mode was dry-jet wet spinning. A resulting cellulose solution extruded from the spinning nozzle fell vertically into a coagulation liquid at an air gap of 20 mm, where a coagulation bath was a 5% hydrogen bond acceptor aqueous solution at 25° C.

(5) A resulting coagulated fiber was washed three times with distilled water at 25° C. and then three times with distilled water at 60° C., and a resulting washed fiber was dried with hot air (at 105° C. for 15 min) in a draw ratio of 1:1.

Example 4

A method for improving a surface structure of a regenerated cellulose fiber was performed as follows:

(1) 10 mol of 3-chloropropene was slowly added dropwise into 10 mol of 1-methylimidazole, and a resulting mixture was then subjected to a reaction at 100° C. for not less than 24 h under nitrogen protection to obtain a hydrogen bond acceptor.

(2) 1.84 g of glycerol (as a hydrogen bond acceptor enhancer), 4.18 g of choline chloride (as a hydrogen bond donor), and 0.32 g of nanocellulose fibril were added into 158.62 g of the hydrogen bond acceptor (with a moisture content of 0.38%) synthesized in step (1) by slowly stirring, and then stirred mechanically at 120° C. for 30 min until mixed evenly to obtain a dissolving system.

(3) 16.46 g of a softwood kraft pulp (with a moisture content of 8.6%) was dispersed, and then mixed with the dissolving system, and stirred mechanically at 80° C. for 10 min.

(4) A resulting uniformly-mixed cellulose viscose (i.e., a cellulose solution) was fed into a single-screw extruder with a screw length-to-diameter ratio of 25:1 and a screw speed of 50 rpm. From a feeding port to an extrusion outlet, four stages of temperature zones were configured, the temperature of which each were 80° C., 165° C., 150° C., and 120° C., respectively. An extrusion head was a vertical single-hole spinning nozzle made of brass and with a diameter of 0.8 mm, and the extrusion mode was dry-jet wet spinning. A resulting cellulose solution extruded from the spinning nozzle fell vertically into a coagulation liquid at an air gap of 20 mm, where a coagulation bath was distilled water at 25° C.

(5) A resulting coagulated fiber was washed three times with distilled water at 25° C. and then three times with distilled water at 60° C., and a resulting washed fiber was dried with hot air (at 105° C. for 15 min) in a draw ratio of 1:1.

Figure 2:
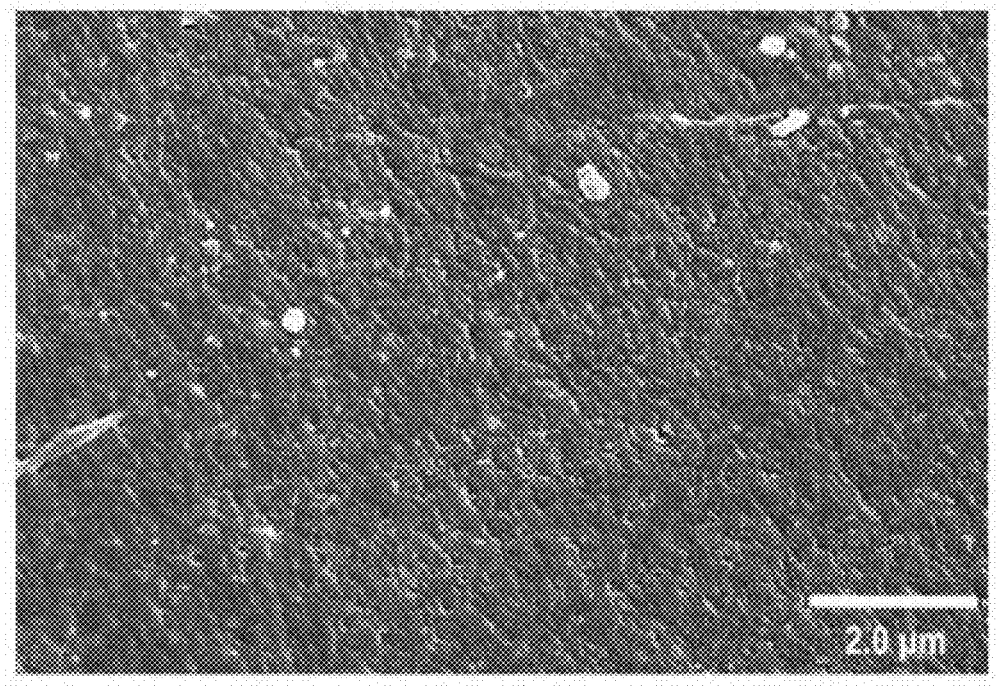
FIG. 2 shows an SEM image of the surface of the regenerated cellulose fiber prepared in Example 2 according to the present disclosure.
Figure 3:
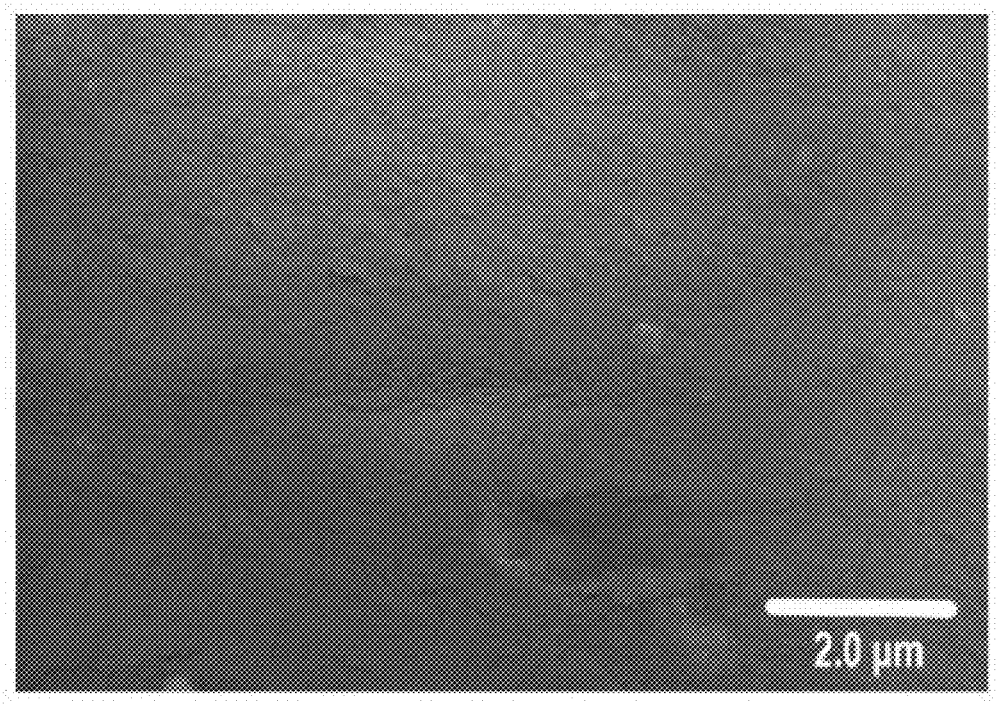
FIG. 3 shows an SEM image of the surface of the regenerated cellulose fiber prepared in Example 4 according to the present disclosure.

Experimental Test:

The performances of the regenerated cellulose fibers prepared in Examples 1 to 4 were tested as follows:

1. SEM test: the SEM test was conducted with Regulus 8220 (Hitachi Ltd., Tokyo, Japan) with a voltage of 5 kV. Before observation, the surface of the fiber was sprayed with gold to increase the conductivity. The results are shown in FIG. 1 to FIG. 3.
2. Breaking strength and breaking elongation: an instrument used was a texture analyzer produced by Stable Microsystems Company, model PL/CEL5, and a test method referred to GBT14337-2008. The results are shown in Table 1.
3. Thermal stability analysis: thermogravimetric analysis (TGA) of the fiber was conducted on a simultaneous thermal analyzer (TA TGAQ50, TA Instruments, New Castle, USA). 30 mg to 40 mg of a sample was placed in an alumina crucible for testing at 35° C. to 800° C. under a nitrogen atmosphere at a flow rate of 40 mL/min, where a heating rate was 10° C./min. The results are shown in Table 1.

TABLE 1

Performance of the regenerated cellulose fibers prepared in Comparative Example and Examples 1 to 4

| Sample | Breaking strength (MPa) | Breaking elongation (%) | Initial modulus (MPa) | Initial decomposition temperature (°C) | Temperature with maximum decomposition rate (°C) |
|---|---|---|---|---|---|
| Comparative Example | 52.44 | 45.68 | 394.29 | 162.64 | 357.86 |
| Example 1 | 68.33 | 15.35 | 1423.67 | 182.20 | 357.49 |
| Example 2 | 118.39 | 14.02 | 3264.26 | 184.80 | 361.62 |
| Example 3 | 141.16 | 15.78 | 3822.41 | 183.89 | 358.49 |
| Example 4 | 219.62 | 15.99 | 7056.21 | 184.21 | 359.57 |

As shown in FIG. 1 to FIG. 3, compared with the control group, the surface of the regenerated cellulose fiber prepared by adding choline chloride (Example 1) is significantly smoother, showing a dense scaly structure. The surface of the regenerated cellulose fiber (Example 4) prepared by adding hydrogen bond donor, hydrogen bond acceptor enhancer and nanocellulose is smoother and denser, and basically has no protrusions and holes. Such regenerated cellulose fiber exhibits an excellent surface structure, which is beneficial to subsequent surface modification and coating of the fiber.

As shown by the data in Table 1, the strength and initial modulus of regenerated cellulose fibers prepared by adding hydrogen bond donor and hydrogen bond acceptor enhancer are greatly improved compared to those of the regenerated cellulose fibers prepared by only adding hydrogen bond donor. The regenerated cellulose fiber prepared in the comparative example has a breaking strength of 52.44 MPa and an initial modulus of 394.29 MPa. The regenerated cellulose fiber prepared in Example 1, during preparation of which choline chloride is added, has a breaking strength of 68.33 MPa, showing an increase of 30.30%, and an initial modulus of 1,423.67 MPa, showing an increase of 261.07%. The regenerated cellulose fiber prepared in Example 4, during the preparation of which a hydrogen bond donor, a hydrogen bond acceptor enhancer and nanocellulose are simultaneously added, shows the most obvious improvement in strength and initial modulus: the breaking strength is 219.62 MPa, which is 318.80% higher than that of the fiber prepared in the comparative example; the initial modulus is 7056.21 MPa, which is 1689.59% higher than that of the fiber prepared in the comparative example.

As shown from the TGA data, the regenerated cellulose fiber prepared by adding hydrogen bond donor, hydrogen bond acceptor enhancer and nanocellulose also plays a certain role in improving the thermal stability of the fiber.

Although the present disclosure is described in detail in conjunction with the foregoing examples, they are only a part of, not all of, the embodiments of the present disclosure. Other embodiments can be obtained based on these examples without creative efforts, and all of these embodiments shall fall within the scope of the present disclosure.

What is claimed is:

1. A method for improving a surface structure of a regenerated cellulose fiber, comprising the following steps:

subjecting a mixture of 3-halopropene and an imidazole-type reagent to substitution reaction to obtain an imidazole-type hydrogen bond acceptor;

mixing a hydrogen bond donor, a hydrogen bond acceptor enhancer and the imidazole-type hydrogen bond acceptor to obtain a dissolving system;

mixing a wood pulp and the dissolving system, and dissolving cellulose of the wood pulp to obtain a cellulose solution; and subjecting the cellulose solution to spinning with dry-jet wet spinning process to obtain a regenerated product, and drying the regenerated product to obtain the regenerated cellulose fiber, wherein the imidazole-type reagent has a structural formula of

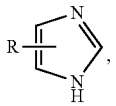

R being selected from the group consisting of H, alkyl, and alkenyl.

2. The method of claim 1, wherein R is $C_1$ to $C_5$ alkyl;

the hydrogen bond donor is one or more selected from the group consisting of urea, formic acid, ethylene glycol, oxalic acid, glycerol, acetamide, malonic acid, and lactic acid; and the hydrogen bond acceptor enhancer is one or more selected from the group consisting of choline chloride, tetrabutylammonium bromide, tetrabutylphosphonium bromide, and betaine.

3. The method of claim 1, wherein the imidazole-type reagent is selected from the group consisting of 1-methylimidazole, 2-methylimidazole, 4-methylimidazole, 1-ethylimidazole, 1-propylimidazole, and imidazole.

4. The method of claim 1, wherein the substitution reaction is conducted under an inert atmosphere at a temperature of 60° C. to 80° C. for 8 h to 24 h.

5. The method of claim 1, further comprising adding nanocellulose into the dissolving system.

6. The method of claim 1, wherein an amount of the imidazole-type hydrogen bond acceptor accounts for 90.0% to 98.0% of a total molar weight of the dissolving system;

the wood pulp is a chemical pulp; and the wood pulp is in an amount of 5 wt % to 15 wt % of a total amount of the dissolving system, and mixing the wood pulp and the dissolving system is conducted at a temperature of 80° C. to 100° C., and the dissolving is conducted for 5 min to 15 min.

7. The method of claim 1, wherein the spinning with dry-jet wet spinning process is conducted by pouring the cellulose solution into a single-screw extruder and conducting a dry-jet wet spinning at a screw length-to-diameter ratio of 20:1 to 30:1 and a screw speed of 50 rpm to 60 rpm;

wherein during the dry-jet wet spinning, a resulting cellulose solution extruded from a spinning nozzle falls vertically into a coagulation liquid at an air gap of 10 mm to 30 mm; and the coagulation liquid has a concentration of an another imidazole-type hydrogen bond acceptor of 0% to 20%, and is at a temperature of 10° C. to 60° C.

8. The method of claim 1, wherein drying the regenerated product is conducted by:

washing the regenerated product until a content of the imidazole-type hydrogen bond acceptor inside the regenerated product is not more than 2%; and drying a resulting washed product by using hot air at a temperature of 105° C. to 120° C. in a draw ratio of 1:(0.9-1.1).

* * * * *